US005407087A

United States Patent [19]

Giblin et al.

[11] Patent Number: 5,407,087

[45] Date of Patent: Apr. 18, 1995

[54] VENTING CLOSURE

[75] Inventors: Edward Giblin, Finksburg; Dominic Marazita, Phoenix, both of Md.

[73] Assignee: Lever Brothers Company, Division of Conopco, Inc., New York, N.Y.

[21] Appl. No.: 140,778

[22] Filed: Oct. 21, 1993

Related U.S. Application Data

[62] Division of Ser. No. 998,287, Dec. 30, 1992.

[51] Int. Cl.[6] ..... B65D 41/00

[52] U.S. Cl. ..... 215/260; 215/270; 215/307; 220/209; 220/257; 220/373

[58] Field of Search ..... 215/232, 235, 233, 250, 215/260, 270, 307, 310, 311, 341, 260; 220/203, 207, 209, 254, 256, 257, 259, 359, 360, 361, 364, 371, 367, 373; 222/153, 212, 546; 229/120; 426/118

[56] References Cited

U.S. PATENT DOCUMENTS

| | | | |
|---|---|---|---|
| 1,576,763 | 3/1926 | Ingram . | |
| 2,241,085 | 5/1941 | Garratt . | |
| 3,114,467 | 12/1963 | Montgomery . | |
| 3,310,193 | 3/1967 | MacPherson . | |
| 3,335,897 | 8/1967 | Castro . | |
| 3,455,481 | 7/1969 | Colgan et al. . | |
| 3,459,324 | 8/1969 | Miller . | |
| 3,696,958 | 10/1972 | Lee . | |
| 3,716,180 | 2/1973 | Bemiss et al. . | |
| 3,805,991 | 4/1974 | Chaladze et al. . | |
| 3,949,734 | 4/1976 | Goglio | 220/209 |
| 3,994,749 | 11/1976 | Decker et al. | 220/209 |
| 4,051,973 | 10/1977 | Botkin . | |
| 4,089,434 | 5/1978 | Tagalakis et al. . | |
| 4,134,535 | 1/1979 | Barthels et al. . | |
| 4,210,255 | 7/1980 | Pan . | |
| 4,448,325 | 5/1984 | Edwards et al. . | |
| 4,461,420 | 7/1984 | Horvath . | |
| 4,487,324 | 12/1984 | Ostrowsky . | |
| 4,561,558 | 12/1985 | Richman et al. . | |
| 4,625,898 | 12/1986 | Hazard . | |
| 4,640,838 | 2/1987 | Isakson et al. . | |
| 4,653,661 | 3/1987 | Buchner et al. . | |
| 4,728,006 | 3/1988 | Drobish et al. . | |
| 4,828,129 | 5/1989 | Jonkers . | |
| 4,993,572 | 2/1991 | Ochs . | |
| 5,096,078 | 3/1992 | McQueeny | 215/270 |
| 5,117,999 | 6/1992 | Canzano et al. . | |

OTHER PUBLICATIONS

Verney Laboratories Product Brochure, copyright 1988.

*Primary Examiner*—Gary E. Elkins
*Attorney, Agent, or Firm*—Gerard J. McGowan,Jr.

[57] ABSTRACT

A closure accommodating internal pressure build-up in a container. The closure includes a cover, the top wall of which which is provided with a small orifice. A flexible plastic film lid or patch is sealed over the orifice by sealant such as adhesive or heat-seal. The patch may also be sealed by welding. The sealant may be pressure sensitive. When pressure within the container reaches a predetermined level, a small channel will form in the patch and gases will be released. The orifice may include pre-formed V-shaped venting notches in its top edge to direct gas pressure.

7 Claims, 4 Drawing Sheets

VENTING CLOSURE

This is a divisional application of Ser. No. 07/998,287, filed on Dec. 30, 1992 pending.

BACKGROUND OF THE INVENTION

It is sometimes desirable to formulate household cleaning and other compositions which under certain conditions of storage or use may generate a gas. For instance, a liquid household cleaning composition including chlorine or oxygen bleach may under some conditions generate a gas. Of course, the generation of any gas in a closed container, especially one which is sealed prior to sale, may make desirable measures to prevent an unanticipated forcible escape of product or gas from the container.

A Vernay Laboratories Inc. Product Brochure copyright 1988 discloses umbrella valves in which the top of the umbrella covers a venting hole.

Pan U.S. Pat. No. 4,210,255 discloses a vent opening closed by a closure held in place by a strip of stretchable material with memory.

Ostrowsky U.S. Pat. No. 4,487,324 discloses a closure including a cylindrical base open at the bottom, an upper wall closing the base at the top, an aperture in the upper wall, a cover hingedly connected to the base with two narrow strips and a wider medial strip, each of the strips having a bend therein, the plug having a plug depending therefrom and accommodated within the aperture when the closure is closed. The cover is biased to two positions, a nearly fully open position and a closed position.

While container closures have been proposed in the past to deal with the problem of over-pressurization, these have not been fully acceptable.

SUMMARY OF THE INVENTION

The present invention solves the problem of accommodating internal pressure build-up in a household product container by providing a closure having a cover, a base and an orifice. In one embodiment, the top wall of the cover is provided with the small orifice. In another embodiment, the orifice is disposed in the base. A flexible plastic film lid or patch is sealed over the orifice. The patch may be a single layer welded to the cover as by radiofrequency or ultrasonic welding or a lamination of a layer with a heat seal coating. The layer should be capable of sealing the orifice. Or, the sealing means may be pressure sensitive. When pressure within the container reaches a predetermined level, a small channel will form in the patch and gases will be released. The orifice may include one or more pre-formed V-shaped venting notches in its top edge to direct gas pressure.

The closure of the invention will release gas pressure rapidly and minimize product leakage in the event that the container is then tipped over. The sealing means such as the heat-seal or adhesive coating may be tailored to provide the desired venting characteristics.

DETAILED DESCRIPTION OF THE INVENTION

Figure 1:
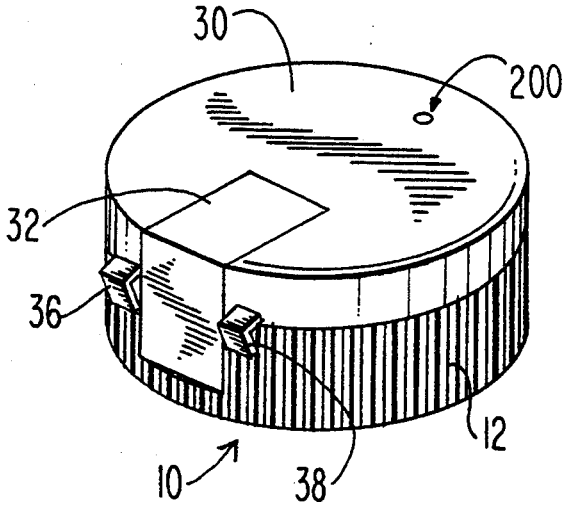
FIG. 1 is a perspective view of the closure of the invention prior to applying the patch.
Figure 2:
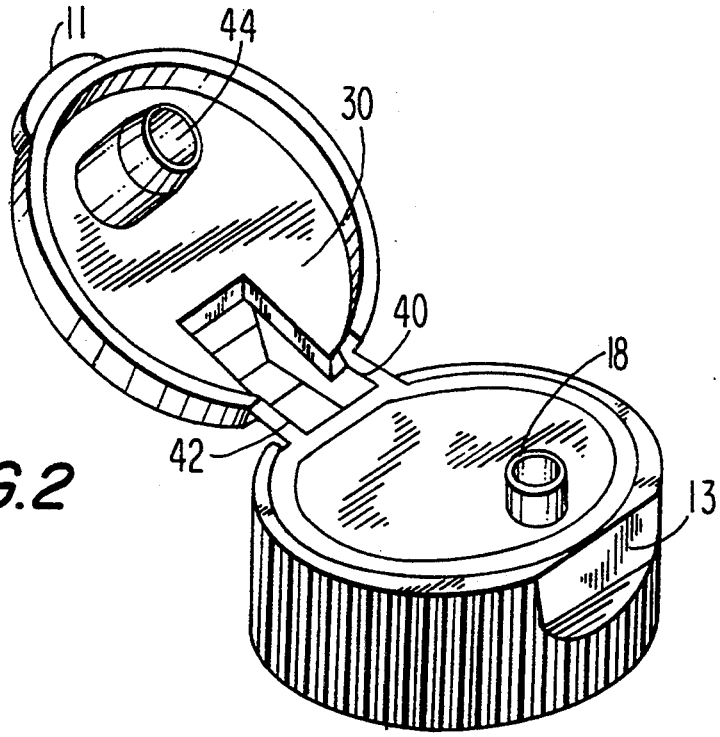
FIG. 2 is a perspective view of the closure of the invention with the cover in the open position.
Figure 3:
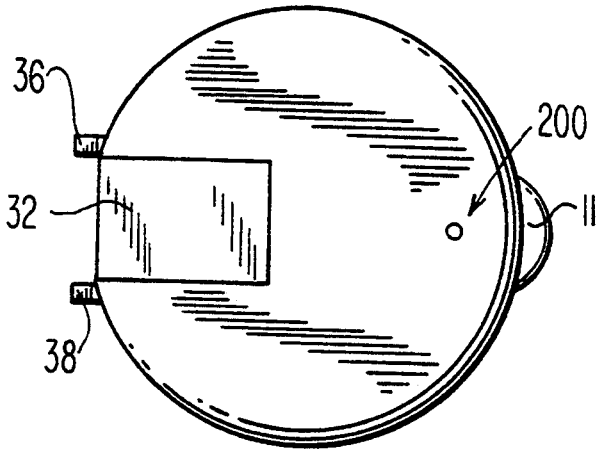
FIG. 3 is a top plan view of the closure of FIG. 1.
Figure 4:
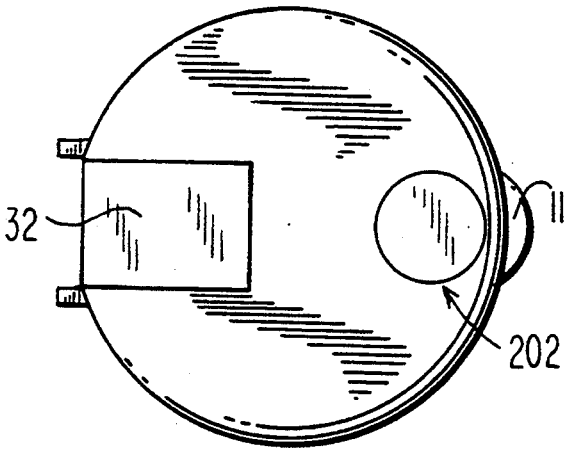
FIG. 4 is a top plan view of the closure of FIG. 3 with the patch applied.

Closure 10 is a modified standard cap of the type available from Seaquist Co. of Crystal Lake, Ill. It is preferably injection molded and is made from polypropylene or other durable thermoplastic. Closure 10 comprises a base 12 having internal threads 14 which will be suitable for mating with external threads on the finish of a bottle or container. Integrally mounted atop circular base 12 is upper wall or deck 16 (FIG. 5) which comprises circular well 18 for receiving a sealing plug on cover 30.

Cover 30 is attached to the base 12 by a medial strip of plastic 32 having a middle transverse crease 34 and by two smaller plastic strips 36 and 38 having middle transverse creases 40 and 42, respectively. Strips 36 and 38 are disposed on either side of strip 32 and are smaller than strip 32. Strips 32, 36 and 38 together with their respective creases function to form a hinge for the closure which permits the cover to rest either in the closed position or in the opened position. The attachment strips form a hinge having over center action wherein the cover is biased to either the fully open (or nearly so) or fully closed position. Such hinges are illustrated in e.g., Ostrowsky U.S. Pat. No. 4,487,324, the disclosure of which is incorporated by reference.

Cover 30 includes sealing plug 44 in upper wall 100.

Figure 5:
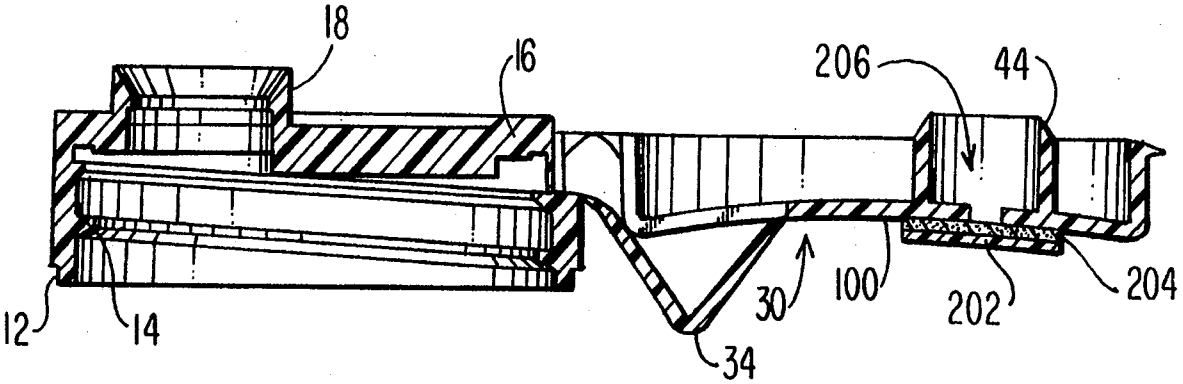
FIG. 5 is a longitudinal cross-section of the closure of the invention with the cover in the open position.
Figure 6:
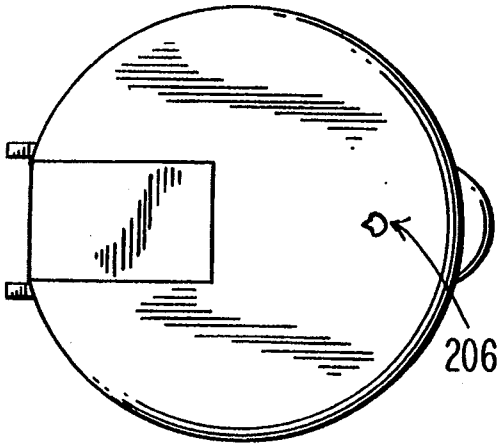
FIG. 6 is a top plan view of an alternate embodiment of the closure of the invention.

In the embodiments illustrated in FIGS. 1–6, upper wall 100 includes a small venting orifice 206. Orifice 206 may be of any desired shape, such as circular. It may include a specially-shaped channel to direct the flow of gas. In the alternate embodiment of FIG. 6, for instance, the top edge of the orifice is formed with a V-shaped notch to channel the gas to a particular location. If desired, more than one such notch may be used. Advantageously, orifice 206 is formed within the cover plug 44, as shown in FIG. 5, since the cover plug is in communication with the interior of the container through circular well 18. The orifice may be disposed elsewhere in the cover provided that it is in communication with the interior of the container. Placement of the orifice within cover plug 44 has the advantage that venting gas and any free product would travel via well 18 and plug 44 to orifice 206 rather than being caught between cover 30 and base 12.

Figure 7:
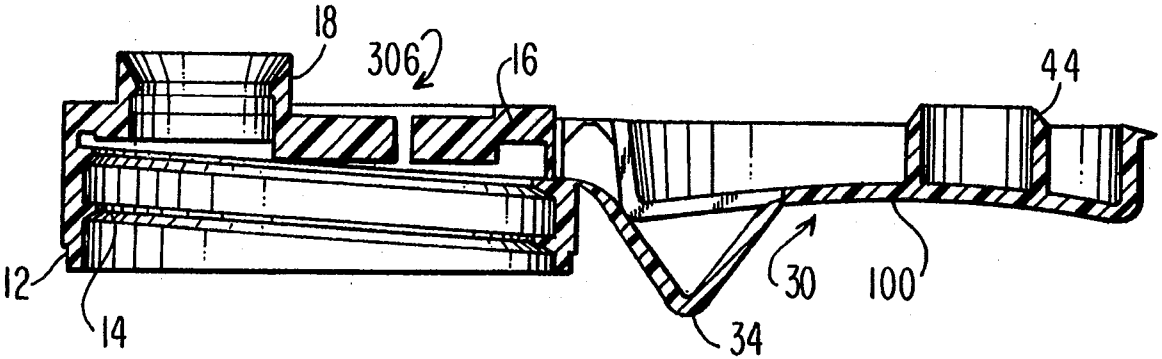
FIG. 7 is a longitudinal cross-section of an alternative closure according to the invention with the cover in the open position.

In the alternate embodiment of FIG. 7, orifice 306 is disposed in upper wall or deck 16 of base 12 rather than in cover 30. Placement of the orifice outside of the cover plug 44 has the advantage that any venting gas or free product will not be free to spurt directly out of the container through the plug but will have to escape through small openings between base 12 and cover 30.

Adhered to the top of upper wall 100 and covering orifice 206 is patch 202. Patch 202 comprises a layer which is preferably a polymeric material such as a thermoplastic film which seals the orifice from fluids. Appropriate materials include polyethylene and polypropylene films. Although polymeric films are preferred, any layer of durable, relatively thin, readily sealable, deformable material which can be adhered to the cover to seal the orifice may be used. The material need not have "memory." Patch 202 is adhered to wall 100 with a sealant layer 204 such as a chemical adhesive, hot melt or a heat seal coating. Patch 202/sealant layer 204 may comprise a lamination of the thermoplastic film with a heat seal coating such as an EVA copolymer sold under the name of Elvax by DuPont, which may be mixed with wax. The wax may be beeswax. Heat seal coatings other than EVA copolymer coatings may also be used. Alternatively, a pressure sensitive labeling material cut to an appropriate shape might, for instance, be used as the patch plus sealant.

As mentioned earlier, the patch may alternatively be sealed to the cover by welding, e.g., radiofrequency or ultrasonic welding. In this case the chemical adhesive is preferably omitted.

The invention does not require a plug or any other sealing components in addition to the patch and the means sealing the patch to the closure.

The size and shape of the orifice, and the material from which the patch and adhering means are made are all determined based on conditions, the pressure, under which which venting is desired.

In operation, the closure will be transported with top 30 closed wherein cylinder 44 is snugly friction fit within well 18. During transportation and storage, in the event that the pressure within the container exceeds a predetermined amount, gas passing through orifice 206 will put pressure on the sealant layer 204 (or the weld) and patch 202. When the pressure reaches a predetermined level, a channel will form and gas and/or liquid product will be released. The channel is formed at the interface of the top 30 of the closure and the patch. In the case of a welded patch, the channel or channels form in the weld. Where a sealant layer is used, the channel or channels will form in the sealant layer.

In the embodiment of FIG. 7, patch is adhered to the top of upper wall 15 and the channel forms at the interface of the upper wall 16 and the patch. The seal between cover 30 and base 12 is not absolute, so gas and or liquid product ejected through orifice 306 can escape from the cap.

It is expected that release of gas and/or liquid will be a momentary occurrence and will be rapid. After the release has occurred the patch will remain in place, although small amounts of leakage are possible. Little product leakage would be expected in the event that the container of the invention tips over.

The invention provides a simple, practical venting system which does not require substantial additional materials or complicated structures. The closure is particularly useful for containers including household products wherein unintended release gas is possible, such as chlorine or oxygen bleach-containing household products.

Preferably the gas/liquid product release occurs at internal pressures within the range of from 2–5 psi, especially from 2–3 psi.

What is claimed is:

1. A closure comprising:

a base suitable for mating with a finish of a container, said base having a top, an upper wall extending across the top of said base, a cover hingedly connected to said base, said cover including an upper wall, an orifice in said upper wall of said base, and a patch sealingly covering said orifice and capable of permitting escape of gas at predetermined elevated pressures.

2. The closure according to claim 1 wherein said patch is adhered to said base upper wall by adhering means selected from the group consisting of chemical adhesive, hot melt, heat seal coating and welding.

3. The closure according to claim 1 wherein said cover is biased toward two positions, a closed position and an open position.

4. A container having a finish sealingly mated to the base of the closure of claim 1.

5. The closure of claim 2 wherein the patch is welded to the base.

6. The closure of claim 2 wherein the adhering means comprises a mixture of wax and an ethylene vinyl acetate copolymer.

7. The closure of claim 3 wherein the adhering means comprises a heat seal coating.

* * * * *